US005157880A

United States Patent [19]

Rotenberg et al.

[11] Patent Number: 5,157,880

[45] Date of Patent: Oct. 27, 1992

[54] INJECTION MOLDABLE PLASTIC LAPS

[75] Inventors: Don H. Rotenberg; Milton F. Whitmarsh, both of Tulsa, Okla.

[73] Assignee: Coburn Optical Industries, Muskogee, Okla.

[21] Appl. No.: 724,503

[22] Filed: Jun. 28, 1991

Related U.S. Application Data

[63] Continuation of Ser. No. 460,378, Jan. 3, 1990, abandoned.

[51] Int. Cl.[5] ..... B24D 17/00

[52] U.S. Cl. ..... 51/358; 51/209 DL; 51/DIG. 34

[58] Field of Search ..... 51/209 R, 209 DL, 358, 51/283 R, 284 R, 129, DIG. 6, DIG. 34

[56] References Cited

U.S. PATENT DOCUMENTS

| | | | |
|---|---|---|---|
| 838,019 | 12/1906 | Gardner | 51/209 R |
| 3,225,497 | 12/1965 | Brandt | 51/284 R X |
| 3,685,214 | 8/1972 | Sarofeen | 51/209 DL |
| 4,001,981 | 1/1977 | Wood | 51/209 R |
| 4,212,136 | 7/1980 | Stertzbach | 51/204 |
| 4,212,137 | 7/1980 | Rue | 51/206.4 |

OTHER PUBLICATIONS

Article: Bulletin No. 25, "Plastic Sphere Lap Package", 1971 (one page).

*Primary Examiner*—M. Rachuba

*Attorney, Agent, or Firm*—Burns, Doane, Swecker & Mathis

[57] ABSTRACT

A lap used for the grinding, fining and polishing of glass and plastic lenses is constructed of a one-piece injection-molded reinforced polymer body. The front surface of the lap is curved and adapted to receive an abrasive pad. The rear of the lap has a skeletal rib structure of projecting interconnected ribs. Polymers suitable for forming the lap include various crystalline polymers and copolymers having adequate chemical resistance, strength, rigidity and thermal resistance.

34 Claims, 2 Drawing Sheets

INJECTION MOLDABLE PLASTIC LAPS

This application is a continuation of application Ser. No. 07/460,378, filed Jan. 3, 1990, now abandoned.

BACKGROUND OF THE INVENTION

The present invention relates to a lapping article used for the grinding, fining, and polishing of glass and plastic ophthalmic lenses and, in particular, to laps made of plastic.

The lapping of glass ophthalmic lenses was originally performed by cast iron laps which were rotated and/or oscillated against a glass lens blank with loose abrasives disposed therebetween to perform grinding, fining and polishing operations on the blank. Eventually, grinding machines were developed to perform the grinding step, but the fining and polishing operations continued to be performed by cast-iron laps. Among their shortcomings, laps tended to wear rapidly, necessitating that they be frequently recut and retrued. Also, the considerable weight of the cast iron laps induced a rapid wearing of the bearings and imposed limitations on both the maximum oscillatory speed which could be attained and the energy efficiency of the lap-driving mechanism.

Eventually, the practice of using loose abrasives was phased out in favor of mounting replaceable abrasive pads on the face of the lap. Because the lap itself would then be subjected to less wear, the laps could be formed of materials exhibiting less toughness and weight than cast iron, such as aluminum and plastic for example.

Attention is directed, for example, to German OS 36 40 678 and OS-37 12 148 which describe plastic laps used in conjunction with replaceable pads. The laps described therein are of solid construction and the bottom faces thereof are provided with customary side notches and central rectangular aperture for proper mating with a face of a receiver to which the laps are to be mounted.

Due to the reduced weight of the plastic laps, the rate of bearing wear is reduced and the efficiency of the lap-driving mechanism is increased. However, room for improvement remains if further reductions in lap weight could be attained.

Furthermore, the techniques presently available for manufacturing plastic laps are limited, due to the need for achieving and maintaining a precision curvature of the pad-receiving front face of the lap. In that regard, the primary function performed by such a lap is to provide a proper shape to the abrasive pads; the pads are flexible and will assume the shape of the front face of the lap. That face must thus exhibit the true optical curvature being imparted to the lens. It is, therefore, necessary that the techniques for making the plastic laps ensure that the proper curvature of the front face will be maintained.

One way of manufacturing solid plastic laps is to extrude a solid plastic cylinder and then cut the cylinder into disks. A curved face would then be machined into one side of the disc to define a pad-supporting surface, and the earlier-mentioned side notches and central rectangular aperture would be cut into the other side of the disc. Due to its solid construction, the lap exhibits sufficient strength to maintain the shape of the abrasive pad applied to the front surface. However, laps made by that technique are very expensive. The laps cannot be made by faster and less expensive techniques, such as high-speed injection molding, because such a large piece of solid plastic would cool much too slowly in the mold and would tend, as it cools, to shrink excessively, as well as to shrink at different rates in different directions, whereby the resulting lap would be warped and the molding cycle excessively long.

Therefore, it would be desirable to not only provide a lighter weight lap but also to provide a lap which can be made by a faster, less costly, and more accurate technique. Such a semi-finished plastic lap would also desirably be easily machinable to exact front-surface curvature on standard lap-cutting machines as has hereinbefore been done with solid plastic and aluminum laps to match the exact curvature desired or the lens surface.

SUMMARY OF THE INVENTION

The present invention relates to a lapping article used for the grinding, fining and polishing of glass and plastic ophthalmic lenses and, in particular, to laps made of plastic. The lap comprises a one-piece injection-molded polymer body with a curved front surface adapted to receive an abrasive pad for grinding, fining, or polishing a glass or plastic ophthalmic lens. Projecting from the rear side of the lap is a skeletal rib structure comprising a plurality of interconnected ribs. The polymer has fiber and/or mineral reinforcement.

In a preferred embodiment, the rear side of the lap comprises an annular outer peripheral rim extending along at least a portion of the outer circumference of the rear side, and a recessed surface disposed radially inwardly of the rim and recessed relative to the rim in a direction toward the front surface.

Polymers suitable for forming the lap include the various homo- and copolymers of polyesters, polyacetals, polyamides, polysulfides and polyimides.

BRIEF DESCRIPTION OF THE DRAWINGS

The objects and advantages of the invention will become apparent from the following detailed description of the preferred embodiment thereof in connection with the accompanying drawings, in which like numerals designate like elements, and in which.

DETAILED DESCRIPTION OF A PREFERRED EMBODIMENT OF THE INVENTION

Figure 1:
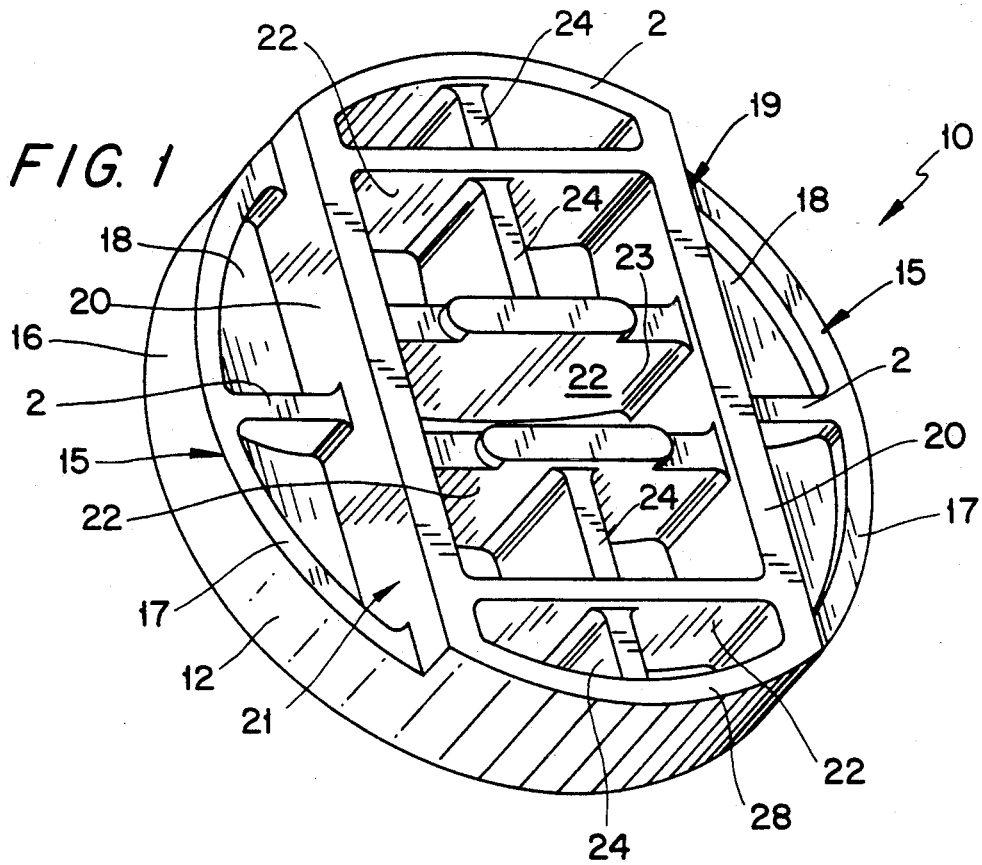
FIG. 1 is a perspective view of the rear side of a lap according to the present invention.
Figure 2:
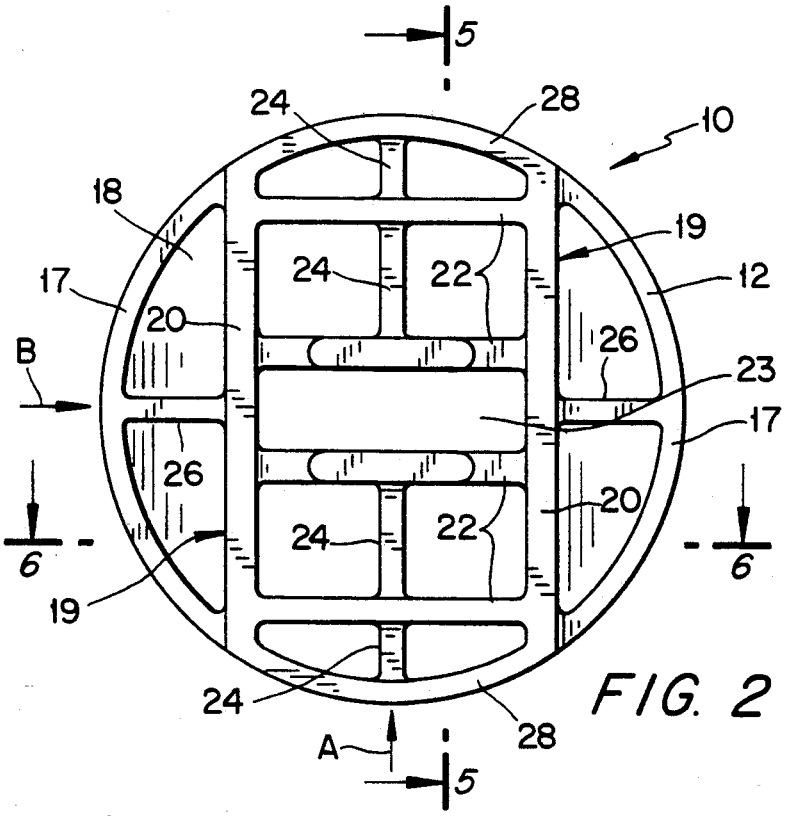
FIG. 2 is an end view of the rear side of the lap.

A lap 10 according to the present invention comprises a one-piece injection-molded body 12 having a curved front surface 14 adapted to receive an abrasive pad for grinding, fining, or polishing a glass or plastic ophthalmic lens. Accordingly, the curvature of the front surface corresponds to the shape of the lens surface being made. While the molded front curvature of the semi-finished plastic lap is close to the desired lens surface curvature, the final exact curvature is cut on a standard lap cutting machine as is done for solid aluminum and plastic laps.

A rear side of the body 12 comprises an annular outer peripheral rim 15 extending along at least a portion of the outer periphery of the body 12. The rim 15 includes annular ridges 16 which have rearwardly facing annular surfaces 17. Disposed radially within the confines of the rim 15 is a recessed surface 18 which is recessed relative to the rim in a direction toward the front surface 14. The recessed surface 18 is preferably curved generally complementary to the front surface 14.

Figure 3:
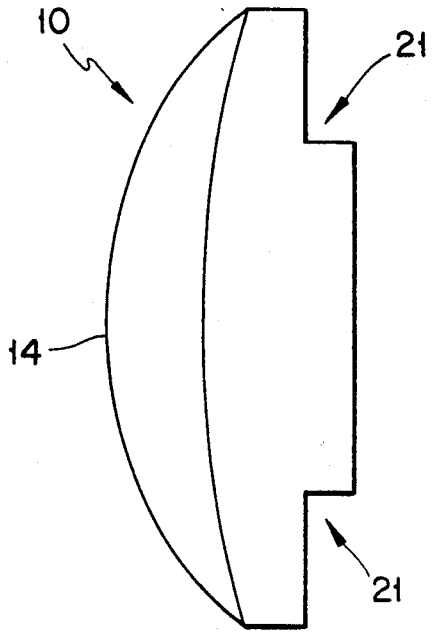
FIG. 3 is a side view of the lap as viewed in the direction of arrow A of FIG. 2.
Figure 4:
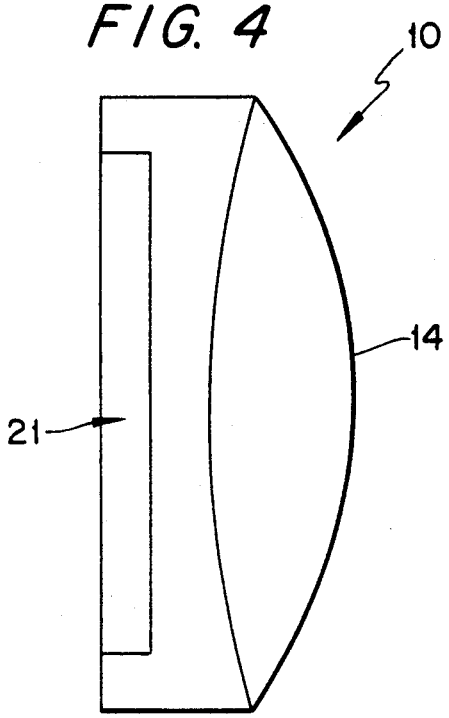
FIG. 4 is a side view of the lap as viewed in the direction of arrow B of FIG. 2.
Figure 5:
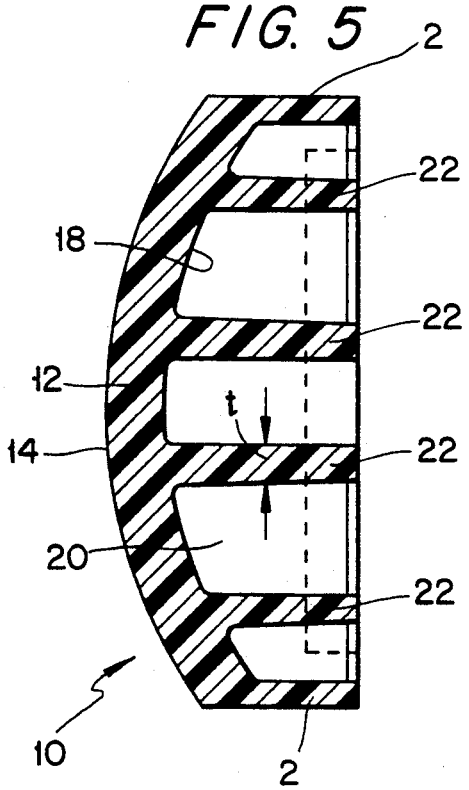
FIG. 5 is a cross-sectional view taken along 5 of FIG. 2.
Figure 6:
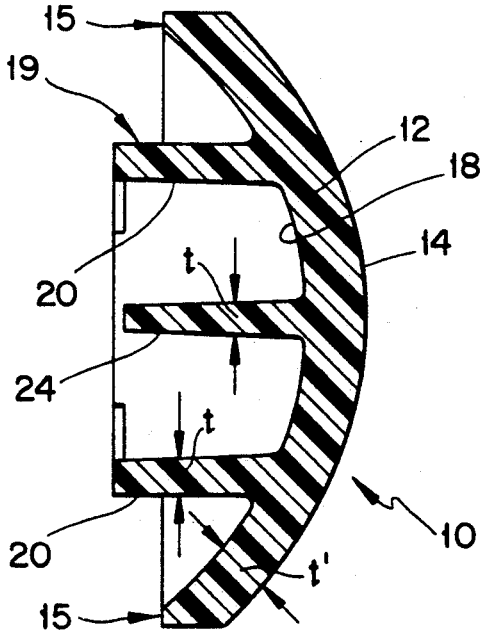
FIG. 6 is a cross-sectional view taken along line 6 of FIG. 2.

Projecting rearwardly from the recessed surface 18 is a skeletal rib structure 19. The rib structure 19 includes a pair of parallel main ribs 20 recessed radially inwardly of portions of the rims 15 to form side notches 21 (see FIG. 3). Interconnecting the main ribs 20 are a plurality of parallel, shorter secondary ribs 22. Two of the secondary ribs 22 are spaced apart to define a central rectangular aperture 23. A plurality of intermediate ribs 24 interconnect the secondary ribs 22 and are disposed parallel to the main ribs 20. A pair of end ribs 26 extend parallel to the secondary ribs 22 and interconnect respective main ribs 18 with a ridge 16. Ends of the main ribs 20 are interconnected by curved walls 28 which define tall extensions of the ridges 16.

Preferably, the cross-sectional thickness t of the ribs and the cross-sectional thickness t' between the surfaces 14, 18 does not exceed 0.5 in. Most preferably, those thicknesses are in the range of 0.1 to 0.35 in. As a result, the lap will cool rapidly enough to be produced by high speed injection molding.

As a result of such a structure, the lap can be economically formed by high speed injection molding operations. That is, since the maximum cross-sectional thickness of the ribs and front portion is 0.5 in., the injection molded lap will cool at a sufficiently rapid rate to adapt to high speed injection molding. Furthermore, the rib structure imparts sufficient strength and rigidity to the front portion to ensure that the front surface will hold its shape during contact with a lens being made. Hence, the lens will be shaped with a proper curvature.

The polymers used in construction of the lap must, in addition to being moldable, have adequate rigidity, strength, thermal resistance, and stability to chemical attack. Suitable materials include crystalline engineering plastics. The crystallinity provides the requisite chemical resistance, and crystallinity, together with the particular molecular structure of the polymer, provides engineering characteristics such as strength and rigidity.

Chemical resistance is important because typical prescription laboratories use chemicals such as acetone or other ketones, and esters which will readily dissolve most non-crystalline polymers.

It will be understood, however, that the invention is not limited to the use of crystalline polymers but encompasses any type of polymeric material suitable for injection molding and having the requisite engineering characteristics and chemical resistance.

The specific strength and rigidity characteristics and/or other characteristics of the polymer are dictated by the particular use intended, for example, expected life of the lap, lap size and lap curvature. One skilled in the art can readily select a specific polymer having the requisite characteristics based on the polymer's known physical properties, e.g. strength and modulus values.

Examples of polymers useful in the invention include homo- and co-polymers of polyesters and polyacetals, polyamides, polysulfides, and polyimides. Of the polyamides, various nylons have good properties, but some absorb significant amounts of water and result in variation in dimensions in actual use. Other polyamides absorb less water but are more expensive. Polysulfides and polyimides, while both have good properties, are significantly more expensive.

Specific examples of suitable polymers include polybutylene terethalate, polyethylene terephthalate, polyoxymethylene, the various nylons, polyphenylene sulfide, and polyimide.

The polymer is preferably filled. While the unfilled polymer is both strong and chemically resistant, it oftentimes cannot be processed easily by injection molding because as it cools, it shrinks excessively and differently in the flow and transverse directions. In addition, unfilled polymer can warp as it cools and thus cannot be made to hold simple tolerances. Incorporation of glass fibers, mineral fillers, or carbon fibers, or combinations thereof, allows for much less and more uniform shrinkage. Warpage will be generally eliminated, and the molded part will hold the required tolerances.

Typical short fiber glass useful as a filler consists of fine particles having a length of from about 0.006 to about 0.014 inches, while suitable longer fiber glass has a length of from about 0.1 to about 0.3 inches, with about 0.200 inches being typical.

The typical mineral filler is finely divided and blended calcium carbonate. Filler content can range from about 10 to about 50 weight percent of the polymer composition, while the polymer itself constitutes from about 90 to about 50 weight percent. Preferred levels of filler are from about 20 to about 45 weight percent with the remainder being the polymer. The ratio of mineral to glass filler can range from 100% mineral to 25% mineral and 75% glass. Similar ratios apply to the use of carbon fiber fillers.

The following Examples and Comparative Examples illustrate the invention.

COMPARATIVE EXAMPLE 1

A thick (1.44 inches), solid lap machined from a molded block of an unfilled polymer blend of polystyrene and polyphenylene oxide designated Noryl N-190 from General Electric Company resulted in a useful but heavy lap. The lap had no chemical resistance as it can be attacked by acetone and other common laboratory chemicals such as Pad Cement Solvent, a solution of ketone and aromatic solvents defined as Coburn Optical Part Number 9839-70.

COMPARATIVE EXAMPLE 2

A thick (1.22 inches), solid lap injection molded from unfilled polybutylene terephthalate designated Valox 325 from General Electric company resulted in long molding cycles (3 minutes or more). Excessive shrinkage and warpage was observed. The lap was not usable.

COMPARATIVE EXAMPLE 3

A hollow, cored lap (maximum cross-section thickness 0.330 inch; height 1.38 inch), injection molded from unfilled polyoxymethylene designated Delrin 500 from E. I. Dupont deNemours Company resulted in a short molding cycle (less than one minute), but showed unacceptable and non-uniform shrinkage and poor dimensional reproducibility. The lap was not usable because of the warpage.

EXAMPLE 1

A less thick (0.97 inch), solid lap injection molded from polybutylene terephthalate filled with 20% mineral and 20% glass designated Valox 735 from General Electric company resulted in long molding cycles. The lap had more controllable and uniform shrinkage and was usable over a limited range of curves.

EXAMPLE 2

A less thick (0.97 inch), solid lap injection molded from polybutylene terephthalate filled with 25% mineral designated Valox 745 from General Electric Company resulted in long molding cycles. The lap had more controllable and uniform shrinkage and was usable over a limited range of curves.

EXAMPLE 3

A hollow, cored lap (maximum cross-section thickness 0.330 inch; height 1.38 inch), injection molded from polybutylene terephthalate filled with 20% mineral and 20% glass designated Valox 735 from General Electric Company resulted in a short molding cycle (less than one minute). The lap had minimum and uniform shrinkage and good dimensional reproducibility. The lap was usable and the optical surface could be machined over a full range of curves.

EXAMPLE 4

A hollow, cored lap (maximum cross-section thickness 0.330 inch; height 1.38 inch), injection molded from polybutylene terephthalate filled with 25% mineral designated Valox 745 from General Electric Company resulted in a short molding cycle (less than one minute), minimum and uniform shrinkage and good dimensional reproducibility. The lap was usable and the optical surface could be machined over a full range of curves.

EXAMPLE 5

A hollow cored lap (maximum cross-section thickness 0.300 inch; height 1.38 inch), injection molded from a polyamide filled with 33% glass designated Zytel Nylon 70G-33L from E. I. DuPont deNemours Company resulted in a short molding cycle (less than one minute). The lap had minimum and uniform shrinkage and good dimensional reproducibility. The lap was usable over a full range of curves.

What is claimed is:

1. A lap for holding an abrasive pad in the manufacture of ophthalmic lens surfaces comprising a body having front and rear sides, a curved front surface formed on said front side and a skeletal rib structure comprising a plurality of interconnected ribs projecting from said rear side to form a plurality of voids in said rear side, said skeletal rib structure spaced radially inwardly from two diametrically opposite portions of an outer circumference of said rear side and projecting rearwardly farther than said portions of said outer circumference to form a pair of side notches between said skeletal rib structure and said portions of said outer circumference, said body being of one-piece injection-molded construction of a reinforced polymer, said polymer having chemical resistance to organic solvents and sufficient rigidity, strength, and thermal resistance for repeated use as a lapping tool.

2. A lap according to claim 1, wherein said rear side comprises an annular outer peripheral rim extending along at least a portion of an outer circumference of said rear side, and a recessed surface disposed radially inwardly of said rim and recessed relative to said rim in a direction toward said front surface, said skeletal rib structure projecting rearwardly from said recessed surface.

3. A lap according to claim 2, wherein said rim comprises an annular ridge having a rearwardly facing annular surface.

4. A lap according to claim 2, wherein said ribs which are recessed radially inwardly relative to portions of said ridge to define two side notches comprise first ribs, said rib structure including additional ribs extending between said first ribs.

5. A lap according to claim 4, wherein said additional ribs include parallel second ribs defining a central generally rectangular aperture.

6. A lap according to claim 5, wherein said additional ribs include at least two third ribs extending between said first ribs and said ridge.

7. A lap according to claim 2, wherein none of said ribs has a cross-sectional thickness greater than 0.50 in.

8. A lap according to claim 1, wherein none of said ribs has a cross-sectional thickness greater than 0.50 in.

9. A lap according to claim 8, wherein a maximum thickness between said front surface and said recessed surface is 0.05 in.

10. A lap according to claim 9, wherein said maximum thickness is 0.35 in.

11. A lap according to claim 1, wherein none of said ribs has a cross-sectional thickness greater than 0.350.

12. A lap according to claim 1, wherein each said ribs has a cross-sectional thickness in the range of 0.10 to 0.35 in.

13. A lap according to claim 1, with the polymer and filler material in the combination of 20 to 45% filler and 80 to 55% polymer.

14. A lap according to claim 1, where the filler is a mineral material.

15. A lap according to claim 1, where the filler is a combination of 100% to 25% mineral and 0 to 75% glass.

16. A lap according to claim 15, wherein the filler includes short-fiber glass having a particle size of from about 0.006 to about 0.14 inch in length.

17. A lap according to claim 15, wherein the filler includes longer fiber glass having a particle size of from about 0.1 to about 0.3 inch in length.

18. A lap according to claim 1, wherein the polymer is a crystalline polymer.

19. A lap according to claim 18, where the polymer is a polyester.

20. A lap according to claim 19, where the polymer is polybutylene terephthalate.

21. A lap according to claim 19, where the polymer is polyethylene terephthalate.

22. A lap according to claim 18, where the polymer is a polyacetal.

23. A lap according to claim 22, where the polymer is polyoxymethylene homo- or co-polymer.

24. A lap according to claim 18, where the polymer is a polyimide.

25. A lap according to claim 18, where the polymer is a polyimide.

26. A lap according to claim 18, where the polymer is a polyphenylene sulfide.

27. A lap according to claim 1, wherein said reinforcement comprises a mineral reinforcement.

28. A lap according to claim 1, wherein said reinforcement comprises a fiber reinforcement.

29. A lap according to claim 1, wherein said reinforcement comprises a mineral reinforcement and a fiber reinforcement.

30. A lap for holding an abrasive pad in the manufacture of ophthalmic lens surfaces comprising a body having front and rear sides, a curved front surface formed on said front side and a skeletal rib structure comprising a plurality of interconnected ribs projecting from said rear side to form a plurality of voids in said rear side, said skeletal rib structure spaced radially inwardly from two diametrically opposite portions of an outer circumference of said rear side and projecting rearwardly farther than said portions of said outer circumference to form a pair of side notches between said skeletal rib structure and said portions of said outer circumference, said body being of one-piece injection-molded construction of a reinforced polymer, said polymer having chemical resistance to organic solvents and sufficient rigidity, strength, and thermal resistance for repeated use as a lapping tool, wherein the amount of reinforcement is sufficient to result in said body being substantially free of warpage after said injection molding, and wherein said front surface and said ribs have a thickness permitting cooling at a rate rapid enough to allow said body to be produced by high speed injection-molding.

31. A lap according to claim 30, wherein the polymer is a crystalline polymer.

32. A lap according to claim 27, wherein said reinforcement comprises a mineral reinforcement.

33. A lap according to claim 27, wherein said reinforcement comprises a fiber reinforcement.

34. A lap according to claim 27, wherein said reinforcement comprises a mineral reinforcement and a fiber reinforcement.

* * * * *